United States Patent [19]

Pollich

[11] Patent Number: 4,635,924

[45] Date of Patent: Jan. 13, 1987

[54] SHEET FEEDER FOR A SHEET-PROCESSING MACHINE

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 775,652

[22] Filed: Sep. 13, 1985

[30] Foreign Application Priority Data

Sep. 15, 1984 [DE] Fed. Rep. of Germany ..... 3433994

[51] Int. Cl.[4] ..... B65H 7/14

[52] U.S. Cl. ..... 271/227; 271/164; 271/241; 271/261

[58] Field of Search ..... 271/227, 241, 162, 164, 271/261

[56] References Cited

U.S. PATENT DOCUMENTS

| | | | |
|---|---|---|---|
| 1,948,001 | 2/1934 | Mensman | 271/164 |
| 3,244,418 | 4/1966 | Henderson | 271/227 |
| 4,245,830 | 1/1981 | Fichte | 271/164 |

FOREIGN PATENT DOCUMENTS

| | | | |
|---|---|---|---|
| 3210943 | 10/1983 | Fed. Rep. of Germany . | |
| 126585 | 7/1977 | German Democratic Rep. . | |
| 60484 | 4/1982 | Japan | 271/227 |

OTHER PUBLICATIONS

IBM Technical Disclosure Bulletin vol. 20, No. 4, pp. 1623–1625, Sep. 1977 "Device for Feeding and Registering Paper", Bantz et al.

*Primary Examiner*—Richard A. Schacher

*Attorney, Agent, or Firm*—Herbert L. Lerner; Laurence A. Greenberg

[57] ABSTRACT

Sheet feeder for a sheet-processing machine having a device for automatically aligning a lateral position of a stack of sheets from which respective sheets to be individually separated are detectable by a conveyor device for transporting the sheets in a given transport direction and feedable to the sheet-processing machine, includes a stack table for carrying the stack of sheets, the stack table being movable transversely to the given transport direction of the sheets, servomotor means for moving the stack table transversely to the given transport direction in response to respective control signals from an actual sheet-position detection device disposed immediately downstream of the sheet stack as viewed in the given transport direction, the detection device having means for detecting the lateral position of the respective sheet just separated from the stack and already fed to the conveyor device.

7 Claims, 4 Drawing Figures

SHEET FEEDER FOR A SHEET-PROCESSING MACHINE

The invention relates to a sheet feeder for sheet processing-machines and, more particularly, to such a sheet feeder having a device for automatically aligning a side position of a stack of sheets from which respective sheets to be individually separated are detectable by a conveyor device and then fed to the sheet processing machine, a servomotor acting upon a stack table carrying the stack of sheets, the stack table being mounted so as to be movable transversely to the sheet conveying direction, the servomotor receiving respective control signals from an actual sheet position detection device.

In sheet processing machines, particularly in printing machines, the sheet individually taken from a stack is generally fed via a feeder table to the machine where it can be processed. A so-called lateral sheet jogger is directly assigned to the machine and moves the sheet to a side marker in order to ensure exact lateral alignment of the sheet for the further processing thereof. The lateral sheet jogger corrects a lateral offset of the individual sheets which is of several millimeters.

The offset of the stacks of sheets to be fed to the machine by the sheet feeders is often so great, however, that an additional lateral preliminary correction of the entire stack or of the sheet located on the feed table is necessary.

From Patent No. 126,585 of the German Democratic Republic, a device is known in which the actual sheet position is determined immediately after the separation or isolation of the sheet from the stack. As a result of a signal provided by the optical detection device employed therein, the conveying equipment along which the sheets are fed over the feeder table is swiveled in a manner corresponding to the determined offset from the nominal or standard conveying direction. The sheet held by suckers executes an additional transverse movement in a vertical direction with respect to this movement as the sheet is being conveyed.

A main disadvantage of such a system particularly lies in the fact that a relatively complex correction device is required because, apart from the mechanical control mechanism, an additional suction device with a corresponding control system and supply of air is also required.

Furthermore, from German Published Non-Prosecuted Application (DE-OS) No. 32 10 943, a system is known in which the position of the individual sheets, when being fed to the sheet processing machine, is detected with regard to the lateral alignment thereof and, corresponding to this position, a servomotor is actuated which moves the platform, on which the stack of sheets rests, traversely to the conveying direction. The control circuit derived from this procedure is to a given extent, subject to dead or idle time because a corrective movement of the stack occurs only after approximately 6 to 8 sheets, depending upon the length of the stream feeding arrangement. In addition, the servomotor is activated for correction purposes by each individual incoming sheet irrespective of its actual position through the use of a single photocell with an appertaining light source.

Starting from the aforementioned state of the art, it is an object of this invention to provide a sheet feeder for sheet processing machines which enables actual position detection, and correction of the individual separated sheets by means of a fast reaction control mechanism without great construction expense, transfer errors of the individual separating and conveyor mechanism being nevertheless determined or detected.

The transfer errors occurring during the individual separation of the sheets can be taken into account in an advantageous manner with the feeder device according to the invention.

By using two reflex light barriers positionable independently of one another, the evaluation result can be influenced, for example, by adjusting the spacing.

If both reflex light barriers which are used are operatively associated with not only one side edge of a sheet, but also a respective one of the reflex light barriers with each of the two side edges of the sheet, additional information with respect to the sheet width is possible to be determined.

If it is necessary or desirable to prevent a control signal from being transmitted to the servomotor when only a single sheet is located outside the tolerance, this control signal can be made dependent upon a given response time of the appertaining reflex light barrier.

With the foregoing and other objects in view, there is provided, in accordance with the invention, a sheet feeder for a sheet-processing machine having a device for automatically aligning a lateral position of a stack of sheets from which respective sheets to be individually separated are detectable by a conveyor device for transporting the sheets in a given transport direction and feedable to the sheet-processing machine, comprising a stack table for carrying the stack of sheets, the stack table being movable transversely to the given transport direction of the sheets, servomotor means for moving the stack table transversely to the given transport direction in response to respective control signals from an actual sheet-position detection device disposed immediately downstream of the sheet stack as viewed in the given transport direction, the detection device having means for detecting the lateral position of the respective sheet just separated from the stack and already fed to the conveyor device.

In accordance with another feature of the invention, the detecting means comprise optically reflex light barriers for detecting varying degrees of light reflection and transmitting the control signals corresponding thereto.

In accordance with a further feature of the invention, two of the reflex light barriers are disposed so as to be operatively associated with a side edge of a respective sheet, the side edge being detectable by only one of the two reflex light barriers when the respective sheet is fed to the sheet-processing machine within a given tolerance, and being detectable by both or neither of the two reflex light barriers when the respective sheet is fed to the sheet-processing machine outside the given tolerance and with a sheet position requiring correction.

In accordance with an additional feature of the invention, a respective one of the optical reflex light barriers is disposed so as to be operatively associated to each of the two side edges of the respective sheet.

In accordance with an added feature of the invention, the detection device transmits the control signals as commands to the servomotor means in accordance with a predetermined response time of the detection device.

In accordance with yet another feature of the invention, the response time of the detection device is variable stepwise, each of the response time steps corresponding to a time span $T_1 = 1/v$, wherein 1 is the sheet length and v the sheet transporting speed, a single respective sheet being detectable during the time span.

In accordance with yet a further feature of the invention, the response time of the detection device is one of smaller than, equal to, and a whole number multiple of the time span.

In accordance with a concomitant feature of the invention, there is provided synchronizing rollers disposed downstream of the sheet stack in the given transport direction, a cross bar arranged in immediate vicinity of the synchronizing rollers and extending over the entire width of the sheet feeder, and brackets mounted so as to be longitudinally shiftable on the cross bar and lockable by clamping screws thereon, the reflex light barriers being fastened to the brackets.

Other features which are considered as characteristic for the invention are set forth in the appended claims.

Although the invention is illustrated and described herein as embodied in sheet feeder for a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
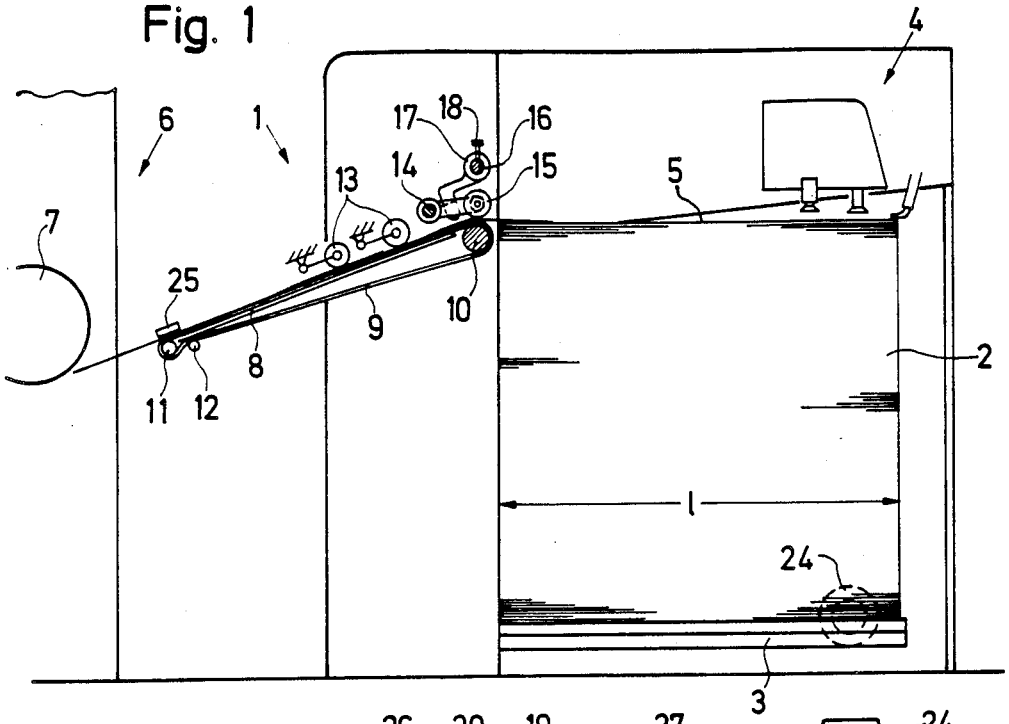
FIG. 1 is a diagrammatic side elevational view of a sheet feeder with a detection device disposed in accordance with the invention.

Referring now to the drawing and first, particularly, to FIG. 1 thereof, there is shown a stack 2 of sheets which rests on a stack table 3 located in a sheet feeder 1. The sheets are taken off individually from above by means of a pneumatically operating individual sheet take-off device 4 which separates the topmost sheet 5 from the stack 2 and directs it to a following conveyor system.

Figure 2:
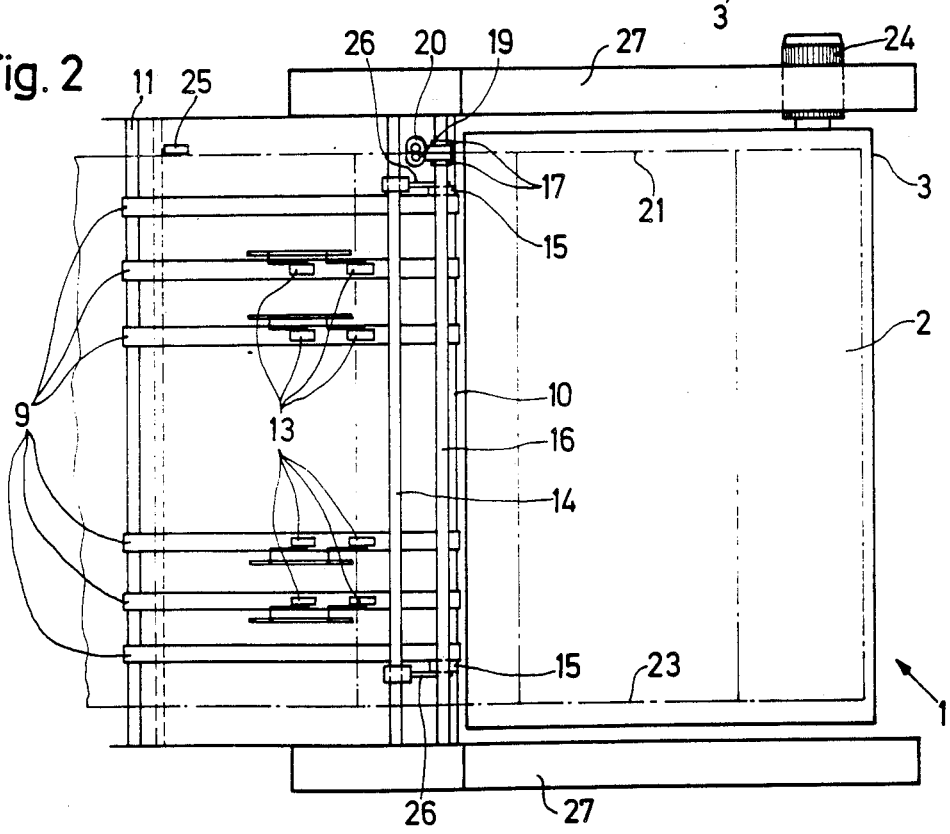
FIG. 2 is a top plan view of FIG. 1.

The conveyor system which feeds the sheet 5 to the printing machine 6 or to a cylinder 7 of the machine 6 is formed firstly of a feed table 8. On the table 8, endless conveyor belts 9 driven by a deflection or reversing roller 10, are arranged at given mutually spaced intervals (note FIG. 2), deflection or reversing rollers 10 and 11 over the entire width of the feed table 8 in front of and behind the feed table 8, as viewed in conveying direction of the sheets. An additional roller 12 controls the tension of the conveyor belts 9. Several conveyor rollers 13 as well as synchronizing rollers 15 mounted on a cross bar or traverse 14 so as to be longitudinally shiftable by means of a support arm 26 are assigned to or operatively associated with the conveyor belts 9 on the feed table 8. These synchronizing rollers 15 are, respectively, lowered onto and lifted off the sheets 5 already individually separated or isolated from the stack, the synchronizing rollers 15 being thus movable cyclically in accordance with the sheet processing speed of the machine 6 and by means of the cross bar or traverse 14 which swivels about its own axis.

Figure 3:
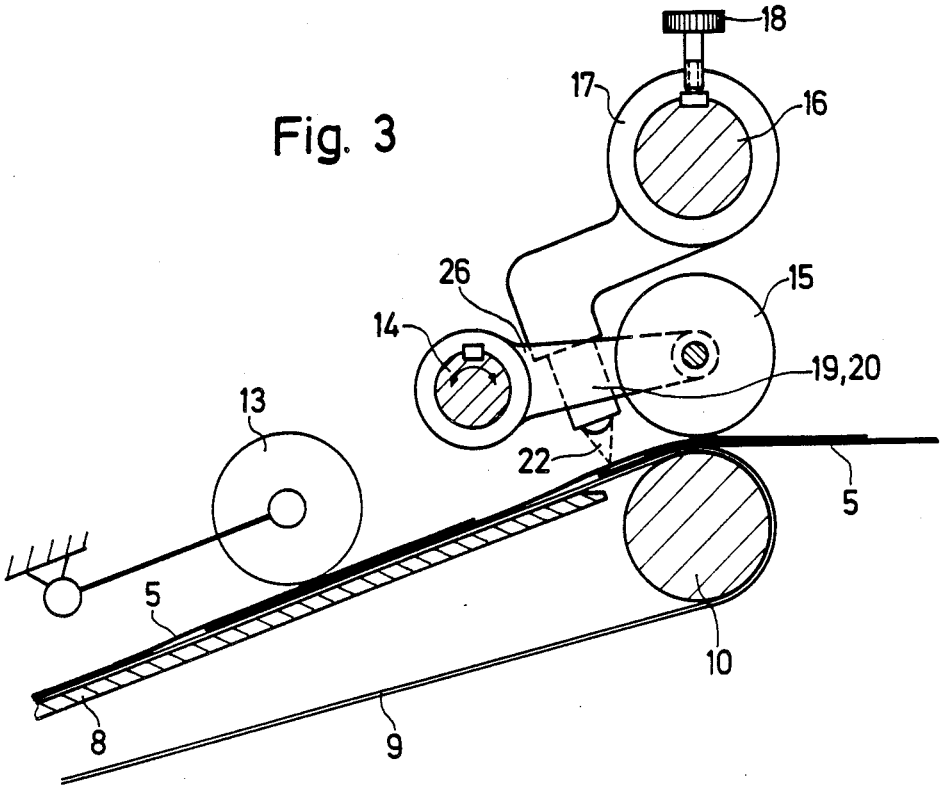
FIG. 3 is an enlarged fragmentary view of FIG. 1 showing the detection device.

Another cross bar or traverse 16 extending across the width of the sheet feeder 1 is provided in the immediate vicinity of the synchronizing rollers 15. As shown in FIG. 3, mounted on the cross bar 16 by means of a bracket 17 lockable in position on the cross bar 16 by clamping screws 18 are optical detection devices in the form of reflex light barriers 19 and 20. Control signals for initiating corrective movements of the stack table 3 are provided as a result of varying degrees of reflection of a light beam 22 which either impinges on a white sheet of paper 5 or passes into "empty space".

Figure 4:
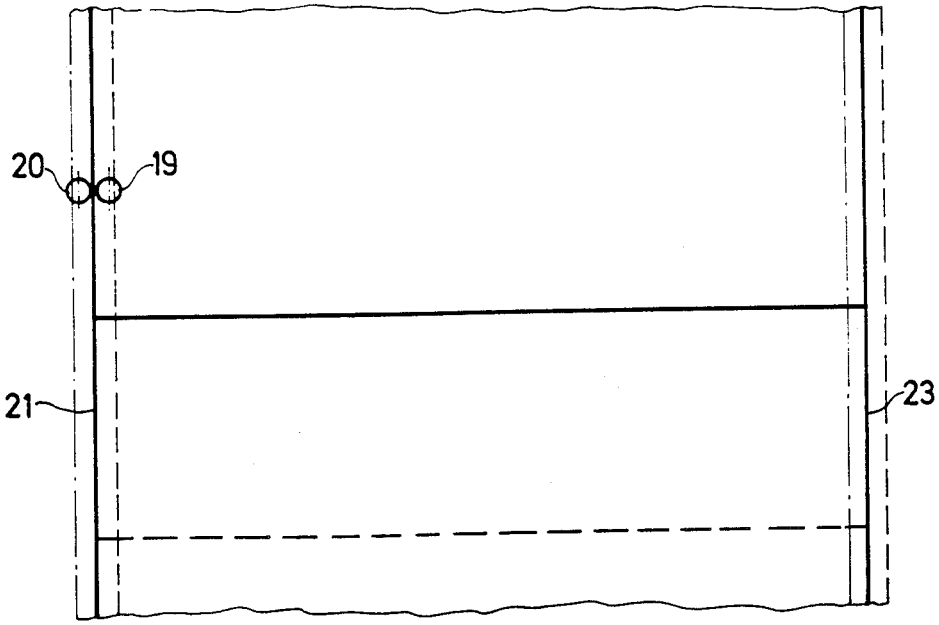
FIG. 4 is an enlarged fragmentary view of FIG. 2 rotated through 90° conterclockwise and showing the stream feed of the sheets with varying actual positions of the sheets.

Due to the fact that the reflex light barriers 19 and 20 can be positioned independently of one another along the cross bar 16, the evaluation result can be varied, for exampled, by changing the distance therebetween. As shown in FIG. 4, the two reflex light barriers 19 and 20 of the embodiment of the invention are assigned to one lateral edge 21 of the sheet.

Whereas the beam of light 22 of one of the reflex light barriers 19 shines on the sheet 5, the light beam 22 of the other reflex light barriers 20 shines into "empty space". The position of the sheet is thus recognized as optimal and therefore requires no correction.

If the sheets 5 are individually taken off the stack 2 outside a given tolerance as a result of a lateral offset the stack 2, and assume the position shown in phantom in FIG. 4, the sheets 5 are detected by both reflex light barriers 19 and 20, which results in a predetermined control signal. This signal is sent to a servomotor 24 which moves the stack table 3 laterally for a given distance in the corresponding direction (towards the right-hand side, as viewed in FIG. 4).

A control signal for moving the stack in the opposite direction is transmitted if, in an equivalent manner, the separated sheets 5 assume the position thereof represented in FIG. 4 by the broken lines (the light of both of the reflex light barriers 19 and 20 goes into "empty space").

A further option would be to assign a reflex light barrier 19, 20 to each of the two side edges 21 and 23 of the sheet 5. In this way, additional information with respect to the width of the sheet could be derived.

If it should be necessary or desirable to prevent a signal from being sent to the servomotor 24 when only one single sheet 5 is outside the tolerance, it is conceivable to select this control signal dependent upon a given response time (T) of the respective reflex light barrier 19, 20. The response time (T) should be selected so that it is variable or adjustable stepwise, one time step corresponding to a time span ($T_1$) resulting from a sheet length (l) and a conveying speed (v) having the relationship ($T_1 = l/v$). $T = n \cdot T_1$ a whole number multiple is applicable if a control signal is desired where the n-th sheet of paper 5 lies outside the tolerance. In order to implement this, it would be necessary to include a resettable or delayed switch-on time-limit relay in the electric control circuit to be provided.

Thereby, the number of sheets 5 can be predetermined, from which the servomotor 24 performs a corrective movement of the stack 2. With the arrangement of the reflex light barriers 19 and 20, according to the invention, the transfer errors during the individual separation of the sheets can be taken into consideration in an advantageous manner so that a side drawing marker 25 is required only for a slight final alignment in order to achieve exact register maintenance of the sheets 5.

If the stack 2 should already be shifted laterally ($T=T_1$) when the first sheet 5 is transported beyond or outside of the tolerance range or more or less immediately after the sheet has been placed in register by means of the reflex light barriers 19 and 20, then an extremely brief reaction time is realized with the aforedescribed device according to the invention.

The foregoing is a description corresponding, in substance, to German application No. P 34 33 994.9, dated Sept. 15, 1984, International priority of which is being claimed for the instant application, and which is hereby made part of this application. Any material discrepancies between the foregoing specification and the specification of the aforementioned corresponding German application are to be resolved in favor of the latter.

There is claimed:

1. Sheet feeder for a sheet-processing machine having a device for automatically aligning a lateral position of a stack of sheets from which respective sheets to be individually separated are detectable by a conveyor device for transporting the sheets in a given transport direction and feedable to the sheet-processing machine, comprising a stack table for carrying the stack of sheets, said stack table being movable transversely to said given transport direction of the sheets, servomotor means for moving said stack table transversely to said given transport direction in response to respective control signals from an actual sheet-position detection device disposed immediately downstream of the sheet stack as viewed in said given transport direction, said detection device having means for detecting the lateral position of the respective sheet just separated from the stack and already fed to the conveyor device, said detecting means comprising optical reflex light barriers for detecting varying degrees of light reflection and transmitting said control signals corresponding thereto, said detection device including two optical reflex light barriers disposed so as to be operatively associated with at least one of the side edges of the respective sheets, said two optical reflex light barriers being positionable independently of one another within a selective distance extending transversely to the respective sheets.

2. Sheet feeder according to claim 1 wherein only two of said reflex light barriers are disposed so as to be operatively associated with one side edge of a respective sheet, the side edge being detectable by only one of said two reflex light barriers when the respective sheet is fed to the sheet-processing machine within a given lateral tolerance, and being detectable by both or neither of said two reflex light barriers when the respective sheet is fed to the sheet-processing machine outside said given tolerance and with a sheet position requiring correction.

3. Sheet feeder according to claim 1 wherein a respective one of said optical reflex light barriers is disposed so as to be operatively associated with each of the two side edges of the respective sheet.

4. Sheet feeder according to claim 1 wherein said detection device transmits said control signals as commands to said servomotor means in accordance with a predetermined response time of said detection device.

5. Sheet feeder according to claim 4 wherein said response time of said detection device is variable stepwise, each of the response time steps corresponding to a time span $T_1=1/v$, wherein 1 is the sheet length and v the sheet transporting speed, a single respective sheet being detectable during said time span.

6. Sheet feeder according to claim 5 wherein said response time of said detection device is one of smaller than, equal to, and a whole number multiple of said time span.

7. Sheet feeder according to claim 1 including synchronizing rollers disposed downstream of the sheet stack in said given transport direction, a cross bar arranged in immediate vicinity of said synchronizing rollers and extending over the entire width of the sheet feeder, and brackets mounted so as to be longitudinally shiftable on said cross bar and lockable by clamping screws thereon, said reflex light barriers being fastened to said brackets.

* * * * *